US007064719B2

(12) United States Patent
Wu et al.

(10) Patent No.: US 7,064,719 B2
(45) Date of Patent: Jun. 20, 2006

(54) MULTI-FREQUENCY ANTENNA MODULE FOR AN ELECTRONIC APPARATUS

(75) Inventors: Chien-Yi Wu, Kaohsiung (TW); Chun-Jen Lin, Hsien (TW); Cheng-Hsiung Wu, Kaohsiung (TW)

(73) Assignee: Quanta Computer, Inc., Tao-Yuan Hsien (TW)

( * ) Notice: Subject to any disclaimer, the term of this patent is extended or adjusted under 35 U.S.C. 154(b) by 0 days.

(21) Appl. No.: 11/088,805

(22) Filed: Mar. 25, 2005

(65) Prior Publication Data

US 2005/0248500 A1 Nov. 10, 2005

(30) Foreign Application Priority Data

May 5, 2004 (TW) ..... 93112606 A

(51) Int. Cl.
*H01Q 1/24* (2006.01)

(52) U.S. Cl. ..... 343/702

(58) Field of Classification Search ..... 343/702, 343/700 MS, 795, 806, 846, 850, 895
See application file for complete search history.

(56) References Cited

U.S. PATENT DOCUMENTS

| | | | | |
|---|---|---|---|---|
| 5,828,342 | A * | 10/1998 | Hayes et al. | 343/702 |
| 6,239,765 | B1 * | 5/2001 | Johnson et al. | 343/795 |
| 6,567,047 | B1 * | 5/2003 | Kuck | 343/700 MS |
| 6,580,397 | B1 * | 6/2003 | Lindell | 343/702 |
| 6,759,990 | B1 * | 7/2004 | Rossman | 343/700 MS |
| 6,809,689 | B1 * | 10/2004 | Chen | 343/700 MS |

* cited by examiner

*Primary Examiner*—Trinh Dinh
*Assistant Examiner*—Huedung X. Cao
(74) *Attorney, Agent, or Firm*—Davidson Berquist Jackson & Gowdey, LLP

(57) ABSTRACT

A multi-frequency antenna module includes first and second radiating elements disposed on a substrate and spaced apart from each other. A serpentine first transmission line conductor of the first radiating element and a second transmission line conductor of the second radiating element contact electrically and respectively first and second electrical contacts on a circuit board in an electronic apparatus when the substrate is mounted in a housing of the electronic apparatus. The first radiating element further includes at least one conducting line that is disposed parallel to second transmission line segments and that interconnects an adjacent pair of parallel first transmission line segments. A grounding line conductor is disposed on the substrate, is coupled electrically to the first radiating element, and contacts electrically a third electrical contact on the circuit board when the substrate is mounted in the housing.

7 Claims, 5 Drawing Sheets

MULTI-FREQUENCY ANTENNA MODULE FOR AN ELECTRONIC APPARATUS

CROSS-REFERENCE TO RELATED APPLICATION

This application claims priority of Taiwanese Application No. 093112606, filed on May 5, 2004.

BACKGROUND OF THE INVENTION

1. Field of the Invention

The invention relates to an antenna module, more particularly to a concealed multi-frequency antenna module.

2. Description of the Related Art

Conventional external-type helical antenna and concealed-type planar inverted F (PIFA) antenna are generally applied to a variety of electronic apparatuses, such as mobile telephones. In actual applications, the conventional helical antenna is mounted externally on an electronic apparatus such that it is susceptible to damage. When the conventional PIFA antenna is applied to a mobile telephone with a reduced size, bandwidth requirements for a high frequency band, such as 1800 MHz and 1900 MHz, are not satisfied. Furthermore, the harmonics generated in a low frequency band, such as 900 MHz, interfere with signal transmission in a high frequency band, such as 1800 MHz.

SUMMARY OF THE INVENTION

Therefore, the object of the present invention is to provide a multi-frequency antenna module for an electronic apparatus that can effectively minimize the harmonics interference for a high frequency band resulting from signal transmission in a low frequency band.

According to the present invention, there is provided a multi-frequency antenna module for an electronic apparatus. The electronic apparatus includes a housing, and a circuit board disposed in the housing and provided with first, second and third electrical contacts thereon. The multi-frequency antenna module comprises:

a dielectric substrate adapted to be mounted in the housing and having a mounting surface;

a first radiating element disposed on the mounting surface of the substrate and including a serpentine first transmission line conductor that has a first free end, and a first contacting end opposite to the first free end and adapted to contact electrically the first electrical contact on the circuit board when the substrate is mounted in the housing, the first transmission line conductor having a plurality of parallel first transmission line segments, and a plurality of parallel second transmission line segments, each of which is transverse to the first transmission line segments and interconnects a respective adjacent pair of the first transmission line segments, the first radiating element further including at least one conducting line that is disposed parallel to the second transmission line segments and that interconnects an adjacent pair of the first transmission line segments;

a second radiating element disposed on the mounting surface of the substrate, spaced apart from the first radiating element, and including a second transmission line conductor that has a second free end, and a second contacting end adapted to contact electrically the second electrical contact on the circuit board when the substrate is mounted in the housing; and a grounding line conductor disposed on the mounting surface of the substrate, coupled electrically to the first radiating element, and adapted to contact electrically the third electrical contact on the circuit board when the substrate is mounted in the housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
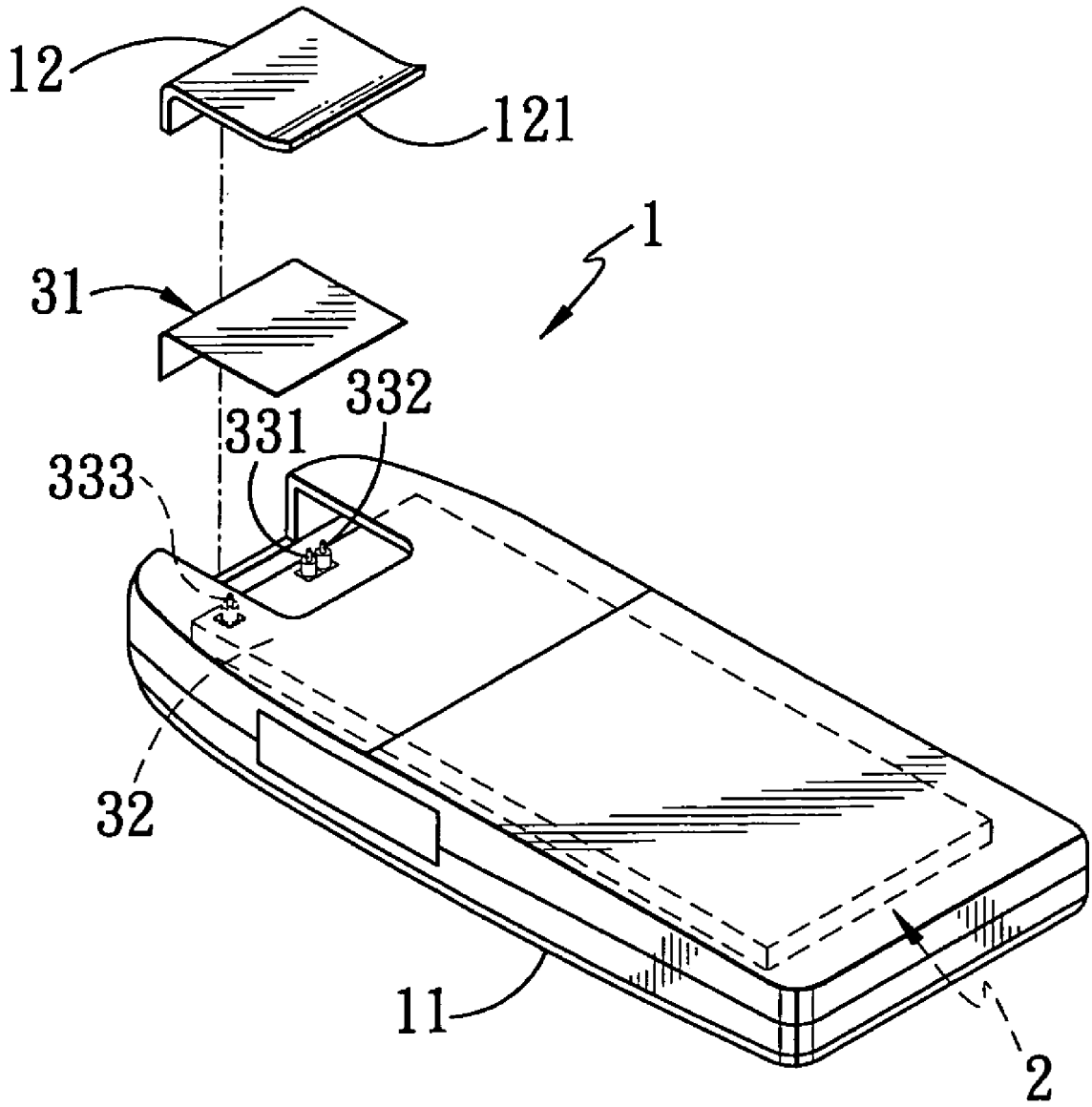
FIG. 1 is an exploded perspective view showing a portable electronic apparatus installed with the preferred embodiment of a multi-frequency antenna module according to the present invention.
Figure 2:
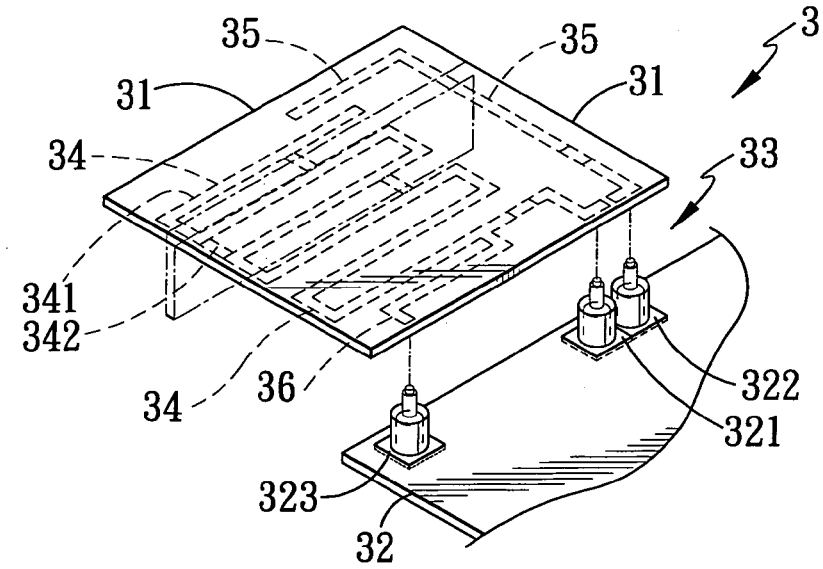
FIG. 2 illustrates how the preferred embodiment is assembled to a circuit board of the portable electronic apparatus.
Figure 3:
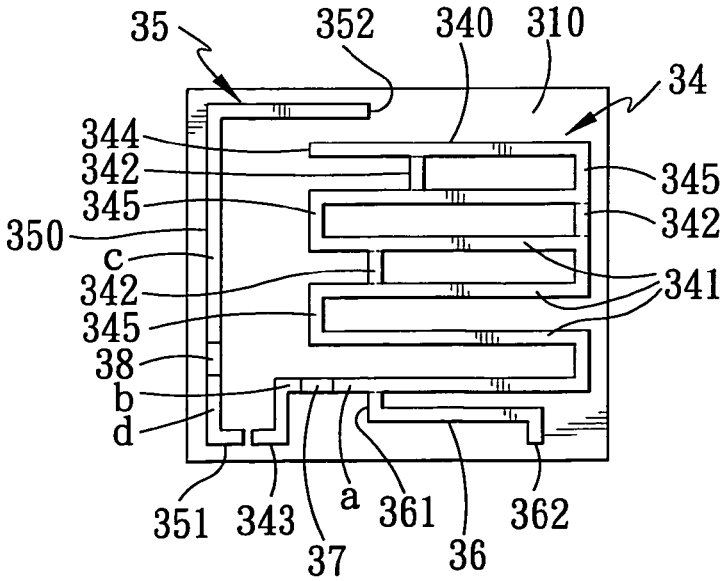
FIG. 3 is a schematic view showing the preferred embodiment.

FIGS. 1 and 2 illustrate the preferred embodiment of a multi-frequency antenna module 3 for an electronic apparatus according to the present invention. In this embodiment, the electronic apparatus is a mobile telephone 1 that includes a housing 11, and a circuit board 32 disposed in the housing 11 and provided with first, second and third electrical contacts 321, 322, 323 thereon, each of which is a spring-loaded electrical contact, as best shown in FIG. 2. The housing 11 is formed with an opening and a cover plate 12 for covering the opening. Referring to FIGS. 2 and 3, the multi-frequency antenna module 3 is shown to include a dielectric substrate 31, a first radiating element 34, a second radiating element 35, and a grounding line conductor 36.

The substrate 31, which is a flexible printed circuit board, is adapted to be mounted in the housing 11 and has a mounting surface 310. In this embodiment, the substrate 31 can be flexed so as to have a contour that corresponds to the inner surface 121 of the cover plate 12.

The first radiating element 34, which is capable of receiving and transmitting signals in a first frequency band, such as a 900 MHz frequency band, is disposed on the mounting surface 310 of the substrate 31, and includes a serpentine first transmission line conductor 340 that has a first free end 344, and a first contacting end 343 opposite to the first free end 344 and adapted to contact electrically the first electrical contact 321 on the circuit board 32 when the substrate 31 is mounted in the housing 11. The first transmission line conductor 340 has a plurality of parallel first transmission line segment 341, and a plurality of parallel second transmission line segments 345, each of which is transverse to the first transmission line segments 341 and interconnects a respective adjacent pair of the first transmission line segments 345. The first radiating element 34 further includes a plurality of connecting lines 342, each of which is disposed parallel to the second transmission line segments 345 and interconnects a respective adjacent pair of the first transmission line segments 341. In this embodiment, the first transmission line conductor 340 is divided into first and second portions (a, b), and is provided with an impedance matching member 37 that interconnects the first and second portions (a, b).

The second radiating element 35, which is capable of receiving and transmitting signals in a second frequency band different from and higher than the first frequency band, such as a 1800/1900 MHz frequency band, is disposed on the mounting surface 310 of the substrate 31, is spaced apart from the first radiating element 34, and includes a generally L-shaped second transmission line conductor 350 that has a second free end 352, and a second contacting end 351 adapted to contact electrically the second electrical contact 322 on the circuit board 32 when the substrate 31 is mounted in the housing 11. In this embodiment, the second transmission line conductor 350 is divided into first and second portions (c, d), and is provided with an impedance matching member 38 that interconnects the first and second portions (c, d) for enhancing transmission power and for increasing transmission bandwidth.

The grounding line conductor 36 is disposed on the mounting surface 31 of the substrate 31, and has opposite ends 361, 362. The end 361 is coupled electrically to the first radiating element 34. The other end 362 is adapted to contact electrically the third electrical contact 323 on the circuit board 32 when the substrate is mounted in the housing 11.

Figure 4:
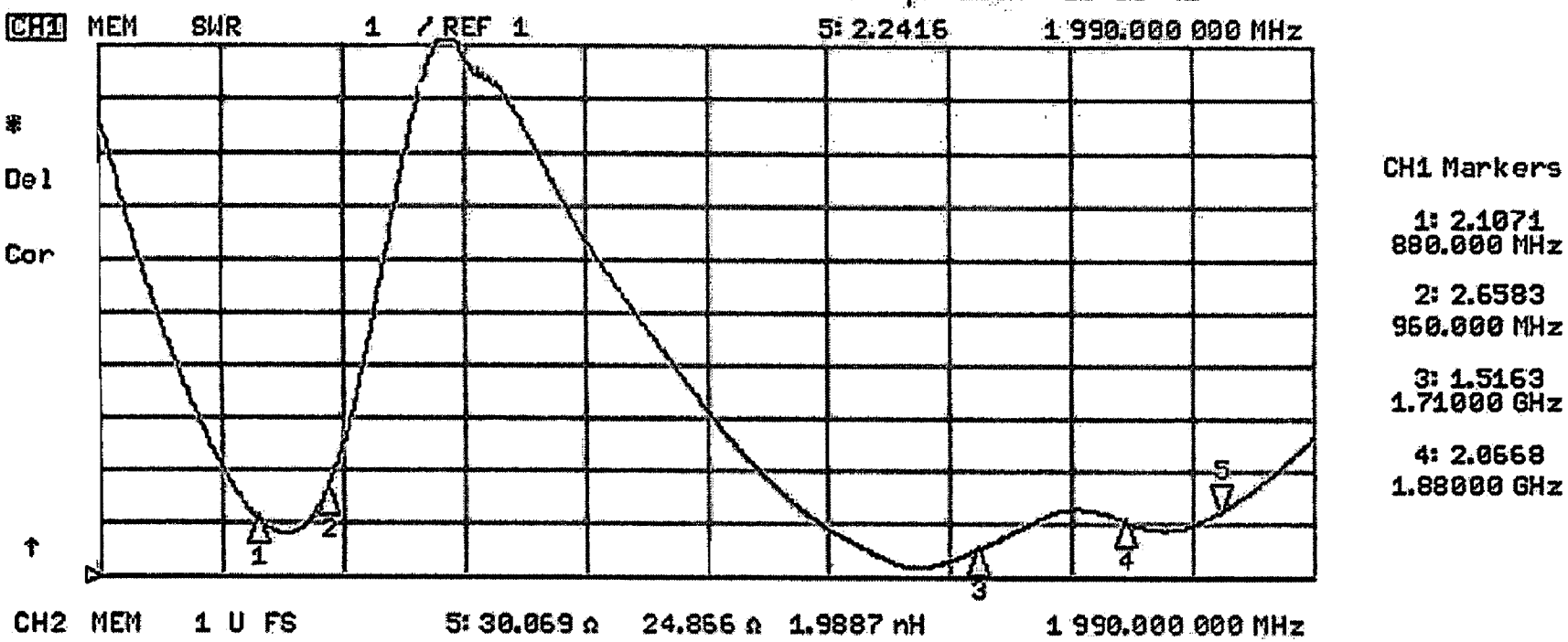
FIG. 4 shows a VSWR chart of the preferred embodiment.
Figure 5:
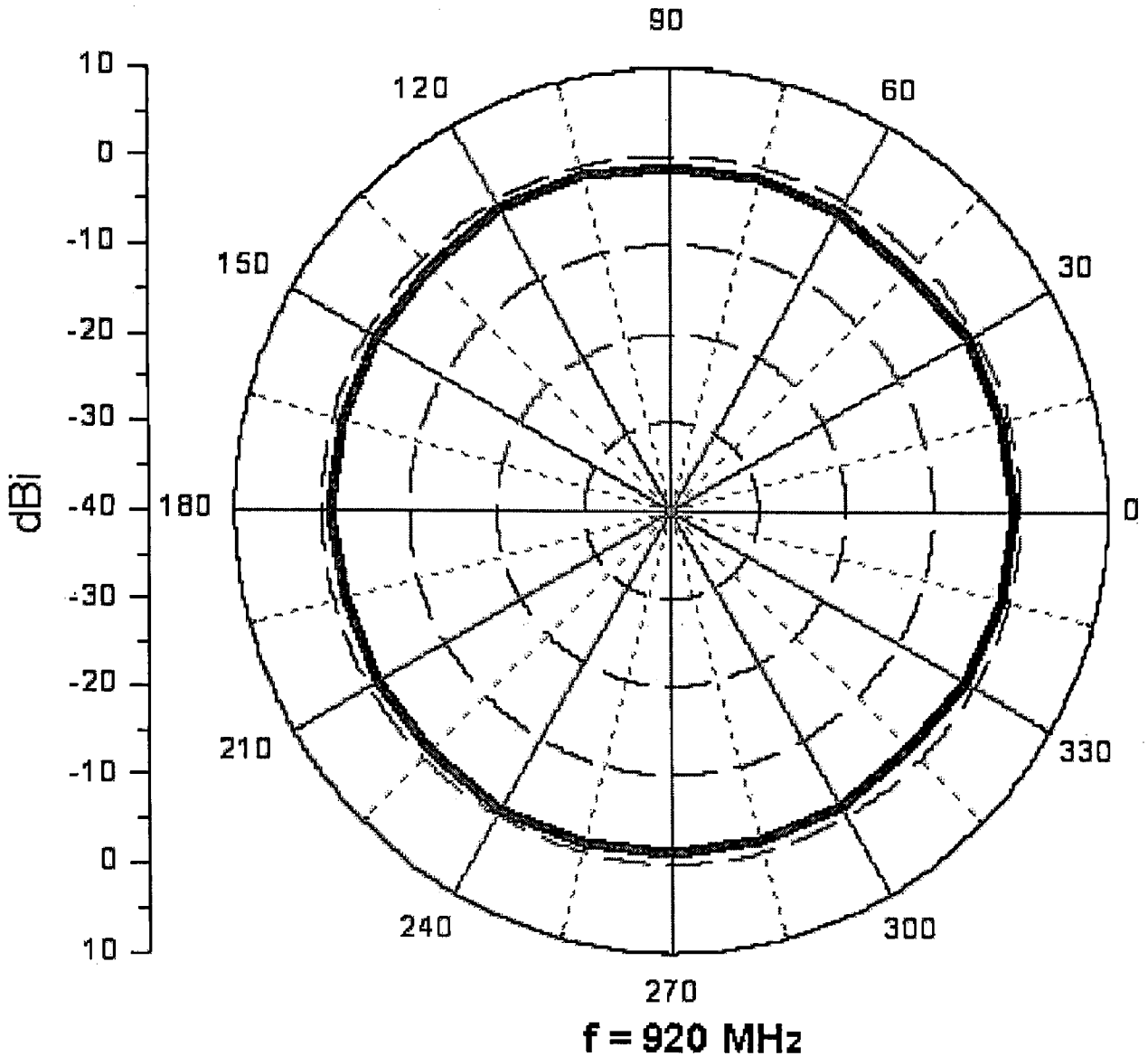
FIG. 5 shows a gain chart of the preferred embodiment in a horizontal plane at 920 MHz.
Figure 6:
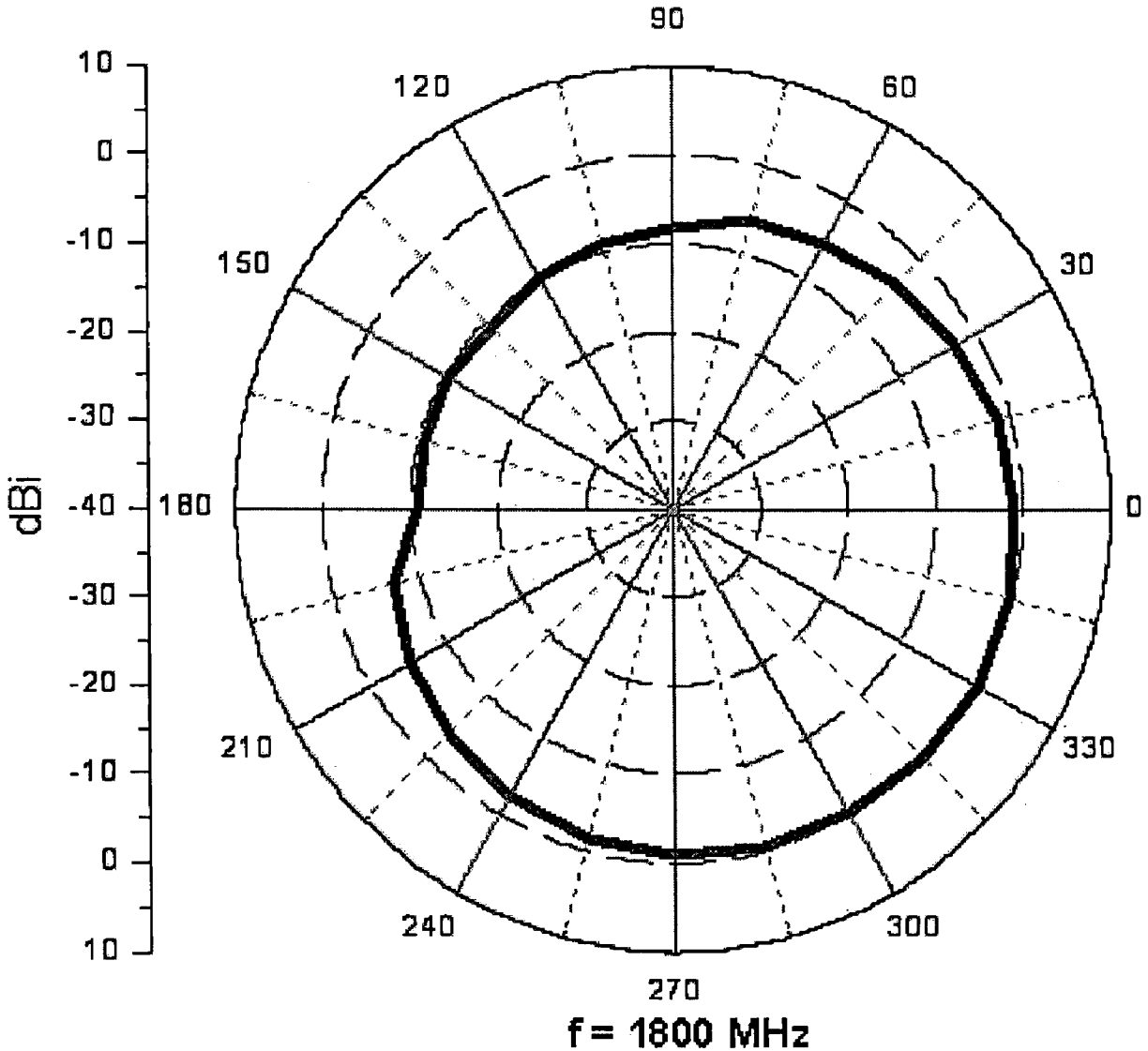
FIG. 6 shows a gain chart of the preferred embodiment in a horizontal plane at 1800 MHz.

FIG. 4 shows the measured voltage standing wave ratio (VSWR) for the multi-frequency antenna module 3 of the present invention. In the chart, standing wave ratios at points S1, S2, S3, S4, S5 are less than or close to 2.6. The point S1 is located at 880 MHz, the point S2 is located at 960 MHz, the point S3 is located at 1710 MHz, the point S4 is located at 1880 MHz, and the point S5 is located at 1990 MHz. The resultant bandwidths are wide enough for the 900 MHz frequency band and the 1800 MHz frequency band. FIGS. 5 and 6 illustrate measured performances of the multi-frequency antenna module 3 in a horizontal plane at 920 MHz and 1800 MHz, respectively.

To sum up, due to the configuration of the first radiating element 34, the multi-frequency antenna module 3 of this invention has a reduced size. It is noted that the spring-loaded electrical contacts 321, 322, 323 on the circuit board 32 enable the substrate 31 to abut against the cover plate 12 such that the multi-frequency antenna 3 of this invention can be easily assembled to the mobile telephone 1. Furthermore, due to the presence of the connecting lines 342, electromagnetic coupling generated by the connecting lines 342 makes a resonating frequency of the harmonics in the 900 MHz frequency band greater than 1800 MHz, even greater than 1900 MHz, such that harmonics interference for the 1800 MHz frequency band can be minimized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A multi-frequency antenna module for an electronic apparatus, the electronic apparatus including a housing, and a circuit board disposed in the housing and provided with first, second and third electrical contacts thereon, said multi-frequency antenna module comprising:

a dielectric substrate adapted to be mounted in the housing and having a mounting surface;

a first radiating element disposed on said mounting surface of said substrate and including a serpentine first transmission line conductor that has a first free end, and a first contacting end opposite to said first free end and adapted to contact electrically the first electrical contact on the circuit board when said substrate is mounted in the housing, said first transmission line conductor having a plurality of parallel first transmission line segments, and a plurality of parallel second transmission line segments, each of which is transverse to said first transmission line segments and interconnects a respective adjacent pair of said first transmission line segments, said first radiating element further including at least one conducting line that is disposed parallel to said second transmission line segments and that interconnects an adjacent pair of said first transmission line segments;

a second radiating element disposed on said mounting surface of said substrate, spaced apart from said first radiating element, and including a second transmission line conductor that has a second free end, and a second contacting end adapted to contact electrically the second electrical contact on the circuit board when said substrate is mounted in the housing; and a grounding line conductor disposed on said mounting surface of said substrate, coupled electrically to said first radiating element, and adapted to contact electrically the third electrical contact on the circuit board when said substrate is mounted in the housing.

2. The multi-frequency antenna module as claimed in claim 1, wherein said substrate is a flexible printed circuit board.

3. The multi-frequency antenna module as claimed in claim 1, wherein said first transmission line conductor of said first radiating element is divided into first and second portions, and is provided with an impedance matching member that interconnects said first and second portions.

4. The multi-frequency antenna module as claimed in claim 1, wherein said second transmission line conductor of said second radiating element is divided into first and second portions, and is provided with an impedance matching member that interconnects said first and second portions.

5. The multi-frequency antenna module as claimed in claim 1, wherein said first radiating element is capable of receiving and transmitting signals in a first frequency band, and said second radiating element is capable of receiving and transmitting signals in a second frequency band different from the first frequency band.

6. The multi-frequency antenna module as claimed in claim 5, wherein the first frequency band is lower than the second frequency band.

7. The multi-frequency antenna module as claimed in claim 1, wherein said second transmission line conductor of said second radiating element is generally L-shaped.

* * * * *